US007325700B1

(12) United States Patent
Masten et al.

(10) Patent No.: US 7,325,700 B1
(45) Date of Patent: Feb. 5, 2008

(54) DISPENSER APPARATUS AND PACKAGING TO INHIBIT PROPAGATION OF HAND-BORNE PATHOGENS

(76) Inventors: R. Michael Masten, P.O. Box 236, Dansville, NY (US) 14437; William Grant Masten, 30 N. Elizabeth, Dansville, NY (US) 14437

( * ) Notice: Subject to any disclaimer, the term of this patent is extended or adjusted under 35 U.S.C. 154(b) by 279 days.

(21) Appl. No.: 11/156,027

(22) Filed: Jun. 17, 2005

Related U.S. Application Data

(60) Provisional application No. 60/580,854, filed on Jun. 18, 2004.

(51) Int. Cl.
*B65H 3/00* (2006.01)

(52) U.S. Cl. ..... 221/265; 221/169; 53/236

(58) Field of Classification Search ..... 53/236; 221/169, 265
See application file for complete search history.

(56) References Cited

U.S. PATENT DOCUMENTS

| | | | | | |
|---|---|---|---|---|---|
| 1,986,658 | A | * | 1/1935 | Witter | 221/197 |
| 2,181,542 | A | * | 11/1939 | Beamer | 221/178 |
| 2,195,177 | A | * | 3/1940 | Kucharsky | 221/199 |
| 3,445,036 | A | | 5/1969 | Sturrock | |
| 3,519,166 | A | | 7/1970 | Yingst | |
| 3,556,344 | A | | 1/1971 | Lane | |
| 3,613,948 | A | | 10/1971 | Wills | |
| 3,737,072 | A | * | 6/1973 | Deitrick | 221/203 |
| 3,968,901 | A | | 7/1976 | Peva, Jr. | |
| 4,124,144 | A | | 11/1978 | Radek | |
| 4,201,313 | A | | 5/1980 | Kirsch | |
| 4,522,314 | A | | 6/1985 | Nelson | |
| 4,567,997 | A | | 2/1986 | Portyansky | |
| 4,826,041 | A | | 5/1989 | Hunt | |
| 5,318,196 | A | | 6/1994 | Cervantes | |
| 5,381,925 | A | | 1/1995 | Cervantes | |
| 5,388,722 | A | | 2/1995 | Kageyama | |
| 5,509,522 | A | * | 4/1996 | Laidlaw | 221/196 |
| 5,531,312 | A | | 7/1996 | Dickey | |
| 5,577,634 | A | * | 11/1996 | Morand | 221/43 |
| 5,743,430 | A | | 4/1998 | Freixas | |
| 5,960,988 | A | | 10/1999 | Freixas | |

FOREIGN PATENT DOCUMENTS

| | | |
|---|---|---|
| EP | 01256520 A1 | 11/2002 |
| EP | 1256520 A1 | 11/2002 |

* cited by examiner

*Primary Examiner*—Gene O. Crawford
*Assistant Examiner*—Timothy Waggoner
(74) *Attorney, Agent, or Firm*—Patent Innovations LLC; John M. Hammond

(57) ABSTRACT

An apparatus for the sanitary dispensing of small stirring straws comprising a dispensing apparatus for dispensing rod-shaped objects comprising a hopper assembly comprised of a hopper bin, and a cylindrical cavity formed beneath said hopper bin; disposed within said cylindrical cavity of said hopper assembly, a conveyor drum for acquiring and indexing at least one rod shaped object; a wheel for accepting and discharging an indexed rod shaped object; and a linkage for triggering said dispensing apparatus to effect the discharge of a rod shaped object.

15 Claims, 17 Drawing Sheets

DISPENSER APPARATUS AND PACKAGING TO INHIBIT PROPAGATION OF HAND-BORNE PATHOGENS

CROSS-REFERENCE TO RELATED PATENT APPLICATIONS

This application claims the benefit of the filing date of U.S. provisional patent application Ser. No. 60/580,854, filed Jun. 18, 2004.

This invention relates generally to the handling of condiments, garnishes, and stirring and drinking utensils used in the food and beverage service industry, and more particularly to methods and apparatus for the sanitary dispensing of small stirring straws that are used to stir coffee, soft drinks, and alcoholic beverages where such beverages are sold, served, dispensed, and/or consumed.

BACKGROUND OF THE INVENTION

1. Field of the Invention

A dispenser apparatus for the sanitary dispensing of small stirring straws that are used to stir coffee, soft drinks, and alcoholic beverages where such beverages are sold, served, dispensed, and/or consumed.

2. Description of Related Art

The present invention is an apparatus and associated packaging for the sanitary dispensing of utensils that are used to stir and drink coffee, soft drinks, and alcoholic beverages. There are a variety of such stirring utensils in common use, with the specific design and function dependent upon the particular beverage. Such utensils are typically made of inexpensive plastic such as polypropylene, and as such, are disposable after a single use.

In the consumption of beverages, such utensils typically take the shape of small tubular straws, or rods having an x-shaped cross-section, and are commonly referred to as swizzle sticks, stir sticks, or stir straws. Additionally, the consumption of soft drinks is often done using a plastic tube commonly referred to simply as a straw.

In the serving of beverages, such utensils are typically dispensed with little or no control regarding sanitary practices. In many venues, such as convenience stores and fast-food restaurants, dispensation is "self-serve", i.e. by the customers. In other situations, dispensation is by bartenders or other staff who are performing a range of duties, many of which are not sanitary. In virtually all of these venues, the dispensing containers for the utensils are devices that result in extensive handling of the utensils by a multitude of unsterile hands. In many instances, the dispensing "device" is simply a cup, into which is dumped a batch of the utensils from a larger storage container.

In view of current self-serve and bartending practice using such dispensing containers, the propagation of hand-borne pathogens is unavoidable. For example, requiring the patrons of convenience stores to wash hands before preparing a self-serve coffee is unrealistic and unenforceable.

Given the numerous other improvements in sanitary practices in food and beverage service in recent years, the unsanitary dispensation of beverage utensils in now among the remaining likely sources of the propagation of hand-borne pathogens such as e.g. *E. coli* and *Salmonella enteritidis*, which result in the outbreaks of "food poisoning" such as e.g. hepatitis, widely covered in the media. There is therefore a need for a dispensing apparatus and associated packaging that can handle such utensils in a manner that prevents any contact of a service worker's or customer's hands with an individual utensil dispensed into a drink, and with the remaining utensils contained in the apparatus, wherein the handling of utensils includes the loading of utensils into the dispenser, as well as the dispensation of utensils from the dispenser.

Heretofore, a number of patents and publications have disclosed beverage utensil dispensing apparatus, the relevant portions of which may be briefly summarized as follows:

U.S. Pat. No. 3,445,036 of Sturrock, issued May 20, 1969, discloses a dispenser, which dispenses straws from a hopper out through a slot in a vending machine. Each individual dispensed straw is handled by human hands.

U.S. Pat. No. 3,519,166 of Yingst et al., issued Jul. 7, 1970, discloses a dispenser, which dispenses straws from a hopper out through a port in a vending machine. The straws are loaded into the dispenser by human hands, and each individual dispensed straw is handled by human hands.

U.S. Pat. No. 3,556,344 of Lane et al, issued Jan. 19, 1971, discloses a dispenser, which dispenses straws in a horizontal direction out of the side of a rectangular box-shaped dispenser. The straws are loaded directly into the dispenser from a package, and are not handled by human hands. Each individual dispensed straw is handled by human hands.

U.S. Pat. No. 3,613,948 of Wills, issued Oct. 19, 1971, discloses a dispenser, which dispenses straws in a vertical direction out of the top of a cylindrical dispenser. The straws are loaded into the dispenser by human hands.

U.S. Pat. No. 3,968,901 of Peva, issued Jul. 13, 1976, discloses a dispenser, which dispenses multiple straws simultaneously into beverage pouches. The straws are loaded into the dispenser by human hands.

U.S. Pat. No. 4,124,144 of Radek, issued Nov. 7, 1978, discloses a dispenser, which dispenses vertically oriented straws from a slot in a cylindrical housing. The straws are loaded into the dispenser by human hands, and each individual dispensed straw is handled by human hands.

U.S. Pat. No. 4,567,997 of Portyansky, issued Feb. 4, 1986, discloses a dispenser, which dispenses straws from a hopper out through a horizontal slot in a base. The straws are loaded into the dispenser by human hands, and each individual dispensed straw is handled by human hands.

U.S. Pat. Nos. 5,318,196 and 5,381,925 of Cervantes et al., issued Jun. 7, 1994 and Jan. 17, 1995, disclose a dispenser, which dispenses straws from a hopper laterally out through a port in a housing. The straws are loaded into the dispenser by human hands, and each individual dispensed straw is handled by human hands.

U.S. Pat. Nos. 5,743,430 and 5,960,988 of Freixas, issued Apr. 28, 1998 and Oct. 5, 1999, disclose a dispenser, which dispenses straws from horizontal slot in a vending machine. The straws are loaded into the dispenser by human hands, and each individual dispensed straw is handled by human hands.

In the use of all of the above dispensers, a human hand either handles the dispensed utensil in order to transfer it into the beverage for use, or handles the utensils during the filling of the dispensers, or both. Thus these dispensers are not capable of dispensing a beverage utensil directly into a beverage container in a sanitary manner.

Other apparatus for dispensing rod-shaped objects is also disclosed in certain U.S. patents. U.S. Pat. No. 3,737,072 of Deitrick, issued Jun. 5, 1973, discloses a feeding device for cylindrical tubing, comprising a cylindrical wheel having a plurality of circumferentially spaced teeth disposed at the base of a trough, and means for reciprocating such wheel in order to discharge by gravity the cylindrical objects carried between the teeth. U.S. Pat. No. 5,531,312 of Dickey, issued Jul. 2, 1996, discloses an apparatus and method for singulating cylindrical articles, comprised of a rotary vacuum wheel having pockets on the outer periphery thereof for selecting and dispensing such articles. The disclosures of both of these United States patents are incorporated herein by reference. Neither of these disclosures provide a means for the sanitary filling and/or discharge of beverage stirring utensils into or from an apparatus.

Accordingly, embodiments of the present invention are provided that meet at least one or more of the following objects of the present invention:

It is an object of this invention to provide an apparatus for the dispensing of a single beverage utensil directly into a beverage container without contacting a human hand.

It is a further object of this invention to provide an apparatus for the dispensing of a single beverage utensil directly into a beverage container in a sanitary manner.

It is another object of this invention to provide packaged beverage utensils, which can be loaded into a utensil dispensing apparatus without contacting human hands.

It is an additional object of this invention to provide packaging for beverage utensils, which enable such utensils to be loaded into a utensil dispensing apparatus without contacting human hands.

SUMMARY OF THE INVENTION

In accordance with the present invention, there is provided a dispensing apparatus for dispensing rod-shaped objects comprising a hopper assembly comprised of a hopper bin, and a cylindrical cavity formed beneath said hopper bin; disposed within said cylindrical cavity of said hopper assembly, a conveyor drum having a central rotational axis, a perimeter surface, and comprising a slot in said perimeter surface for acquiring and indexing one of said rod shaped objects, and a pinion extending outwardly along said central rotational axis through an end wall of said cylindrical cavity; an actuating linkage assembly connected to said hopper assembly; said actuating linkage assembly including an actuator bar, and a rack engaged with said pinion wherein displacing said actuator bar rotates said pinion and said conveyor drum around said central rotational axis; and a chute for receiving said one of said rod shaped objects from said slot in said conveyor drum and guiding said one of said rod shaped objects out of said dispensing apparatus.

In accordance with the present invention, there is further provided a dispensing apparatus for dispensing rod-shaped objects comprising a hopper assembly comprised of a hopper bin, and a cylindrical cavity formed beneath said hopper bin; disposed within said cylindrical cavity of said hopper assembly, a conveyor drum having a central rotational axis, a perimeter surface, and comprising a slot in said perimeter surface for acquiring and indexing one of said rod shaped objects, and a pinion extending outwardly along said central rotational axis through an end wall of said cylindrical cavity; an actuating linkage assembly connected to said hopper assembly; said actuating linkage assembly including an actuator bar, and a rack engaged with said pinion wherein displacing said actuator bar rotates said pinion and said conveyor drum around said central rotational axis; a chute for receiving said one of said rod shaped objects from said slot in said conveyor drum and guiding said one of said rod shaped objects out of said dispensing apparatus; and a rotatable wheel engaged with an electric motor, said rotatable wheel for engaging and driving said one of said rod shaped objects that is received from said chute out of said apparatus.

In accordance with the present invention, there is further provided a dispensing apparatus for dispensing rod-shaped objects comprising a hopper assembly comprised of a hopper bin, and a cylindrical cavity formed beneath said hopper bin; disposed within said cylindrical cavity of said hopper assembly, means for acquiring a rod shaped object at a first position, and indexing said rod shaped object to a second position, thereby conveying an indexed rod shaped object; means for actuating said dispensing apparatus to effect the dispensation of said rod shaped objects; and means for discharging said indexed rod shaped object.

In various further embodiments, the hopper assembly of the dispensing apparatus may further comprise a first hopper half and a second hopper half, the apparatus designed such that both halves are identical, thereby reducing manufacturing cost of the apparatus. The apparatus may further comprise a housing and a cover that encloses the hopper assembly, the conveyor drum, and at least part of the linkage assembly. The apparatus is preferably provided with an on-board electric power supply in embodiments which include a wheel driven by an electric motor.

One aspect of the invention is based on the observation of problems with conventional beverage utensil dispensers, which do not dispense utensils in a downward direction from the lower surface of the dispenser. Such dispensers are not suitable for delivering a utensil directly into a liquid-filled beverage container without handling by a human hand, and often dispense more than a single utensil in a delivery. This aspect is based on the discovery of a technique that alleviates these problems by precisely metering out single utensils in a downward direction directly into a beverage container placed beneath the apparatus.

This technique can be implemented, for example, by providing means in the apparatus which withdraws a single utensil from the bulk storage container thereof, and delivering it downwardly through an opening in the bottom of the apparatus.

The technique described above is advantageous because it is simple, inexpensive, and effective in dispensing beverage utensils untouched by human hands directly into beverage containers. As a result of the invention, the sanitary dispensing of beverage utensils in establishments such as convenience stores, fast food restaurants, and taverns is enabled. In various embodiments, the apparatus may be portable or mounted on a fixture; and the apparatus may be human actuated, or driven by an electric motor or other electromechanical means.

BRIEF DESCRIPTION OF THE DRAWINGS

The invention will be described by reference to the following drawings, in which like numerals refer to like elements, and in which.

Figure 1:
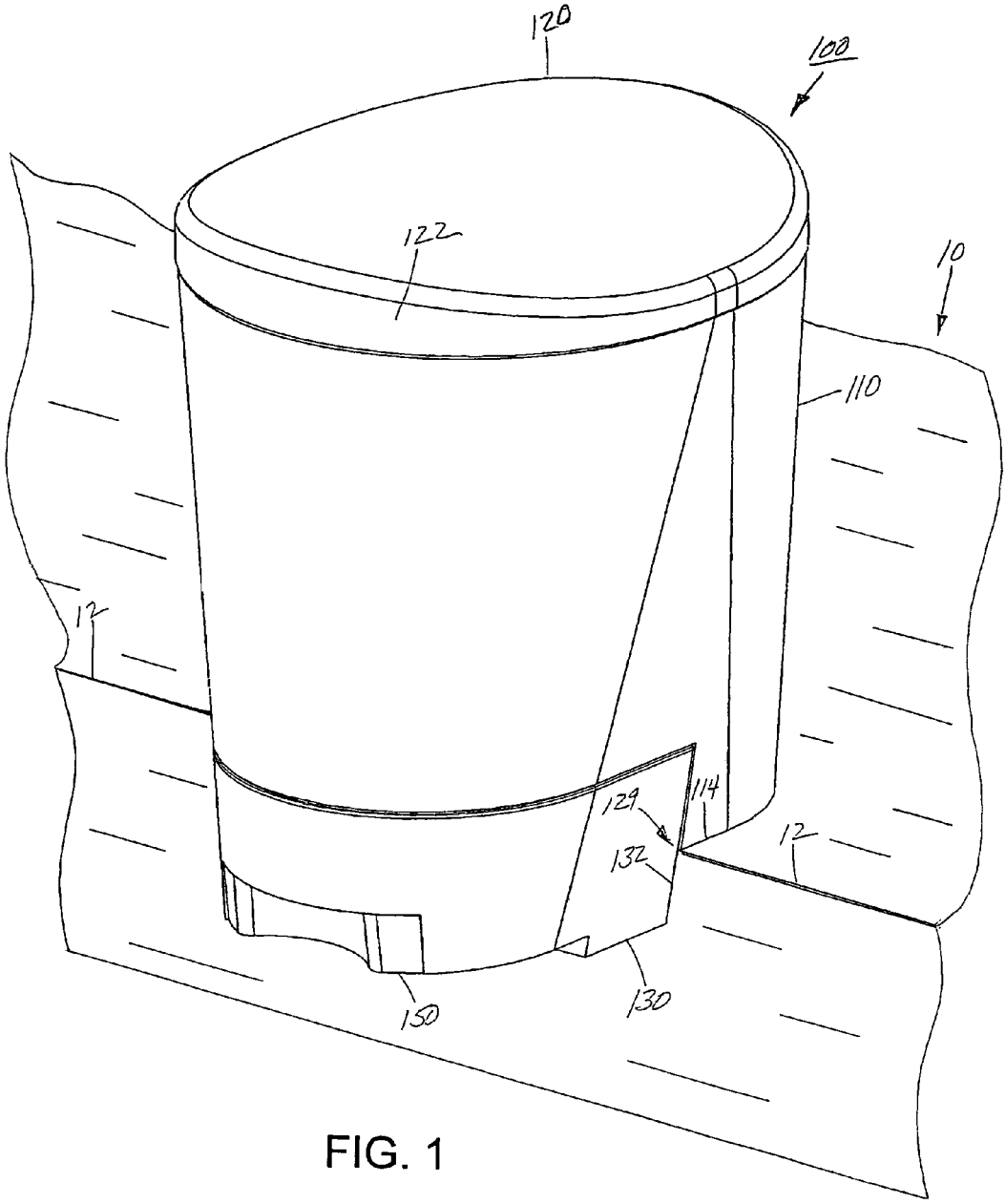
FIG. 1 is a perspective view of the dispensing apparatus, or dispenser, of the present invention, placed at the edge of a food or beverage serving surface.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements. In describing the present invention, a variety of terms are used in the description. Standard terminology is widely used in food and beverage preparation art.

Figure 2:
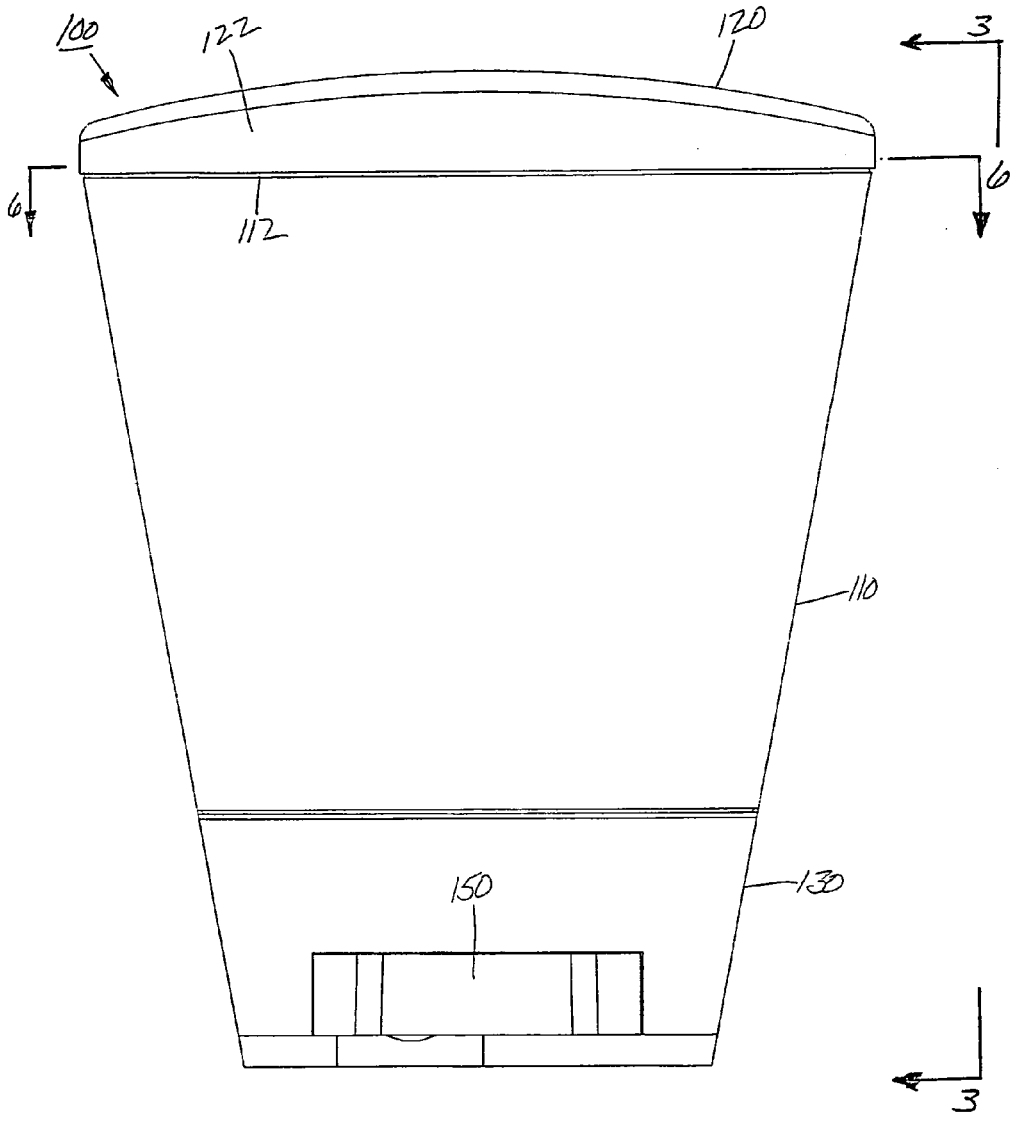
FIG. 2 is a front view of the dispenser of FIG. 1, the front view being defined as the view seen by a user during use of the dispenser.
Figure 3:
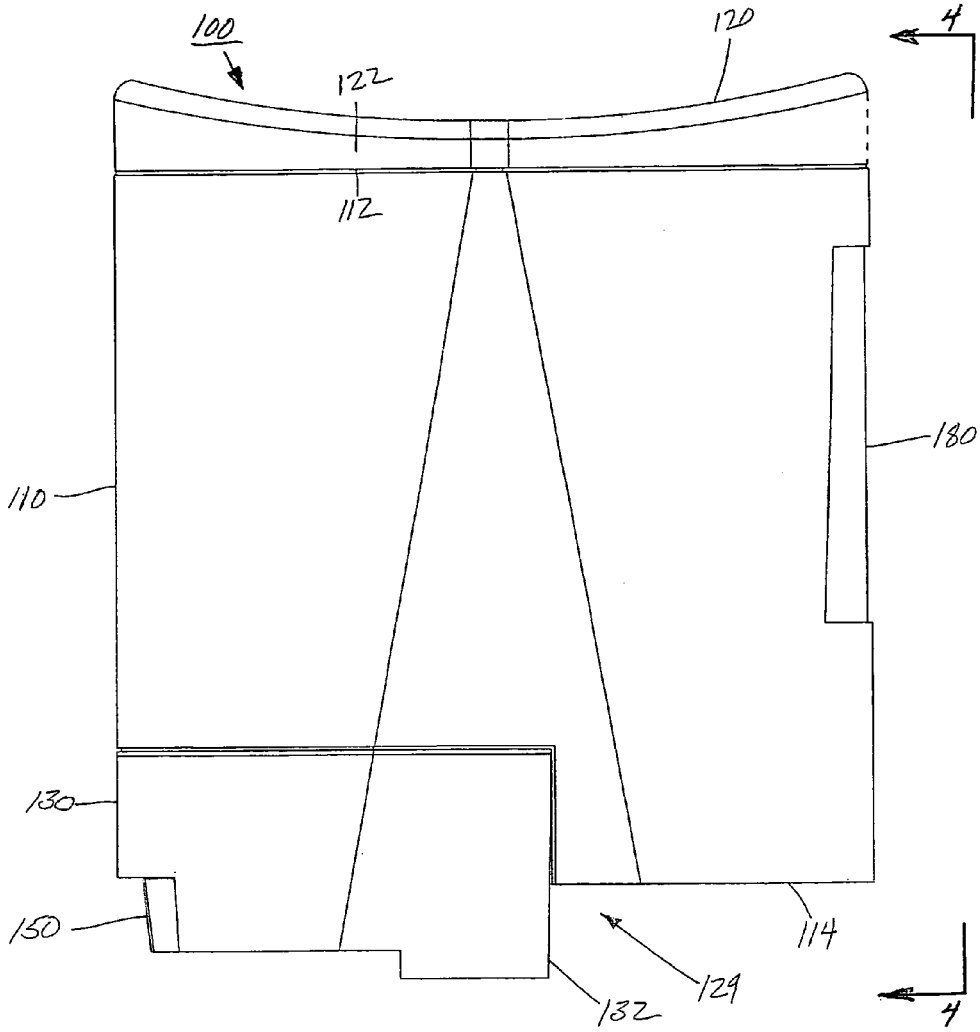
FIG. 3 is a side view of the dispenser of FIG. 1, taken along line 3-3 of FIG. 2.
Figure 4:
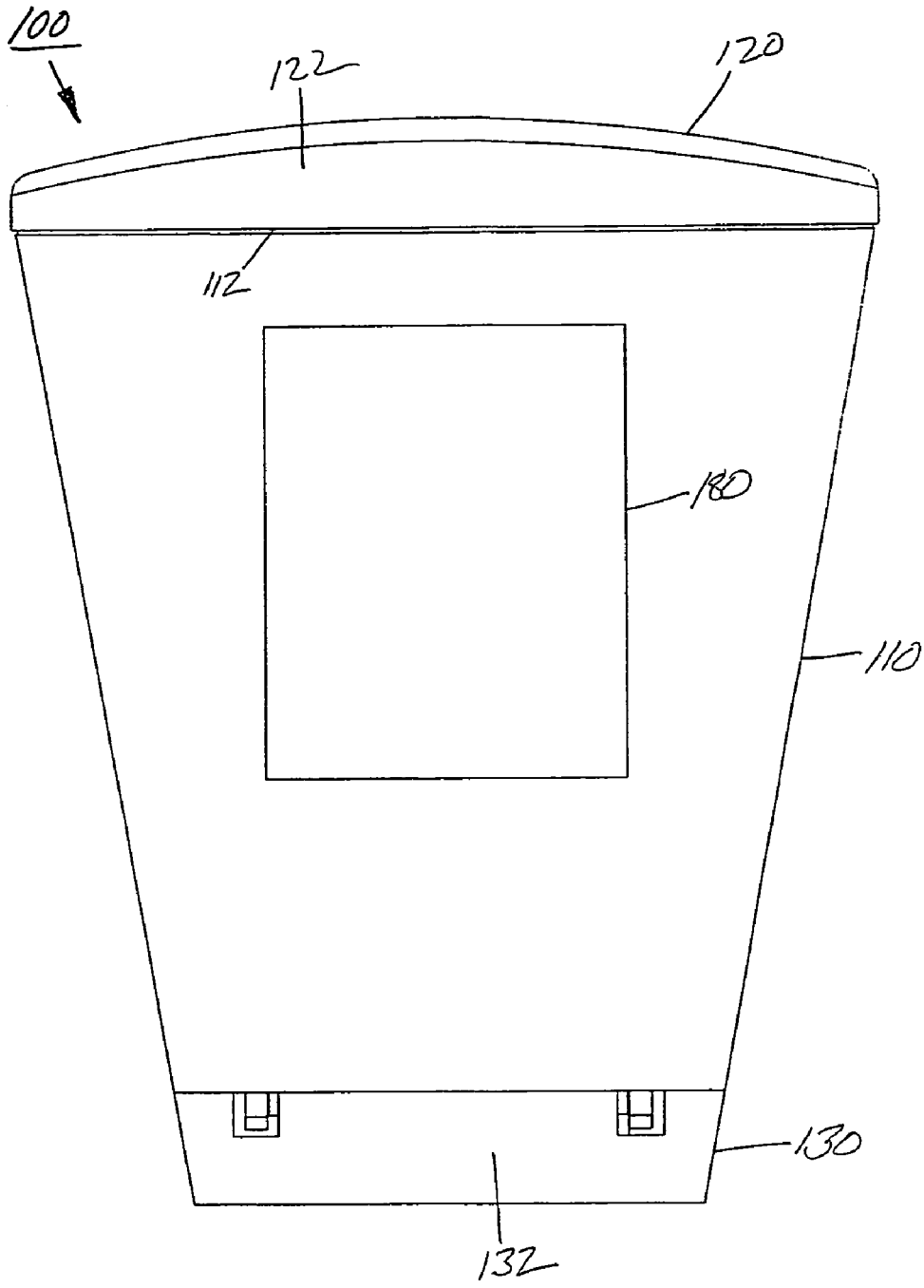
FIG. 4 is a back view of the dispenser of FIG. 1, taken along line 4-4 of FIG. 3.

FIG. 1 is a perspective view of the dispensing apparatus, or dispenser, of the present invention. FIG. 2A is a front view of the dispenser of FIG. 1, the front view being defined as the view seen by a user during use of the dispenser. FIG. 3 is a side view of the dispenser of FIG. 1, taken along line 3-3 of FIG. 2. FIG. 4 is a back view of the dispenser of FIG. 1, taken along line 4-4 of FIG. 3. Referring to FIGS. 1-4, dispenser 100 is depicted disposed upon the edge of a countertop or bar 10, positioned for its intended use. Dispenser 100 comprises a housing 110, upon which is disposed removable cover 120. Dispenser 100 further comprises a base 130, an actuator bar 150 for triggering the dispensing action, and a name plate 180.

Housing 110 is preferably formed of a thin walled polymer shell by molding or another suitable fabrication process. In one embodiment, housing 110 consists essentially of a PC/ABS polymer blend (polyethylene terephthalate/poly (acrylonitrile butadiene styrene)), formed by injection molding. The wall thickness of housing 110 is preferably between about 2 millimeters (mm) and about 6 millimeters. In like manner, removable cover 120 is also formed of similar materials and using similar fabrication processes, and has similar wall thickness. The vertical wall 122 of removable cover 120 is provided such that removable cover engages in a slip fit with the upper lip 112 of housing 110. In this manner, removable cover fits neatly upon housing 110, with an aesthetically pleasing appearance, but is easily removed therefrom.

Referring again to FIGS. 1-4, base 130 is fastened to housing 110; the manner of such fastening will be described subsequently in this specification. The rearmost vertical edge 132 of base 130, together with the rearward lower edge 114 of housing 110 provide a substantially square step 129 at which dispenser 100 is placed upon the edge 12 of countertop 10. Base 130 further serves to provide a housing for and an access to actuator bar 150. In one embodiment, base 130 is formed of similar materials and using similar fabrication processes as has been described for housing 110 and cover 120.

The primary functions of housing 110, cover 120, and base 130 in an assembled state are to provide an overall housing and fixturing for the mechanical and electrical components therein, which effect the storage, inner movement, and discharging of a stir straw from the dispenser; and to provide an aesthetically pleasing appearance of the overall dispenser product when viewed by the purchasers of an establishment and/or by the customers of an establishment. It will be apparent that certain attributes related to the appearance of the dispenser, such as e.g. the saddle shape of the cover 120, or the elliptical shape of the housing 110 may be varied considerably, while still maintaining the overall dispensing function of the dispenser 100.

Figure 5A:
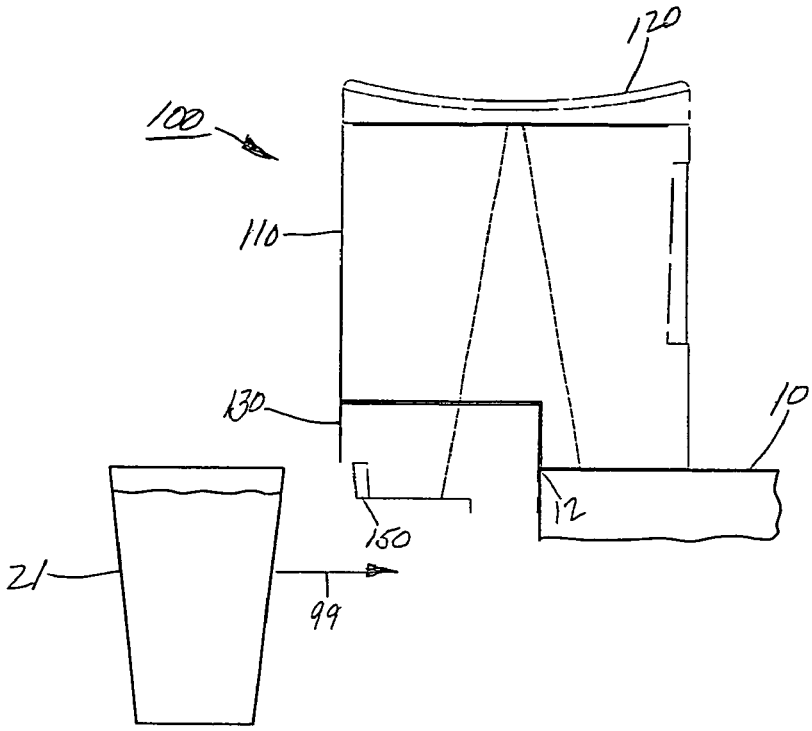
FIG. 5A is a side view of the dispenser of FIG. 1, shown prior to the dispensing of a stir straw into a glass.
Figure 5B:
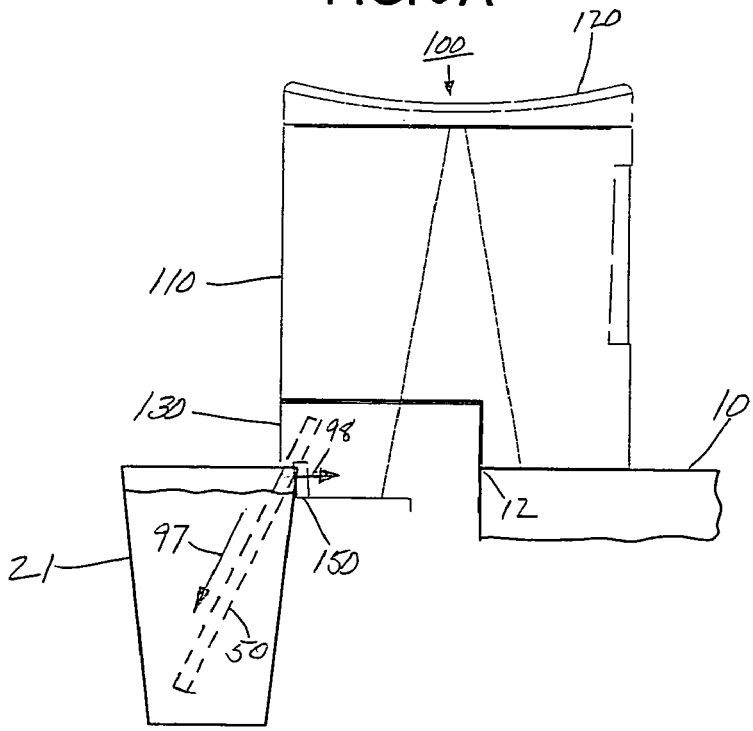
FIG. 5B is a side view of the dispenser of FIG. 1, shown immediately following the dispensing of a stir straw into a glass.

The general manner in which dispenser 100 is operated in order to dispense a stir straw will now be described with reference to FIGS. 5A and 5B. FIG. 5A is a side view of the dispenser of FIG. 1, shown prior to the dispensing of a stir straw into a glass; and FIG. 5B is a side view of the dispenser of FIG. 1, shown immediately following the dispensing of a stir straw into a glass. Referring to FIG. 5A, prior to the dispensation of a stir straw, a customer or server (not shown) holds his/her glass 21 (or cup or other container) proximate to the actuator bar 150 of dispenser 100. The customer/server moves glass 21 substantially horizontally as indicated by arrow 99 toward actuator bar 150.

Referring to FIG. 5B, the customer moves glass 21 into contact with actuator bar 150, and displaces actuator bar 150 horizontally as indicated by arrow 98. Mechanical and/or electromechanical means housed within dispenser 100 are actuated, resulting in the dispensation of stir straw 50 downwardly into glass 21 as indicated by arrow 97. The means which effect the inner movement, and discharging of a stir straw 50 from dispenser 100 will now be described in detail with reference to FIGS. 6-17B.

The internal structure of the applicant's dispenser will first be described with reference in particular to FIGS. 6-11.

Subsequently, the operation of the applicant's dispenser will be described with reference to FIGS. 11-17B.

Figure 6:
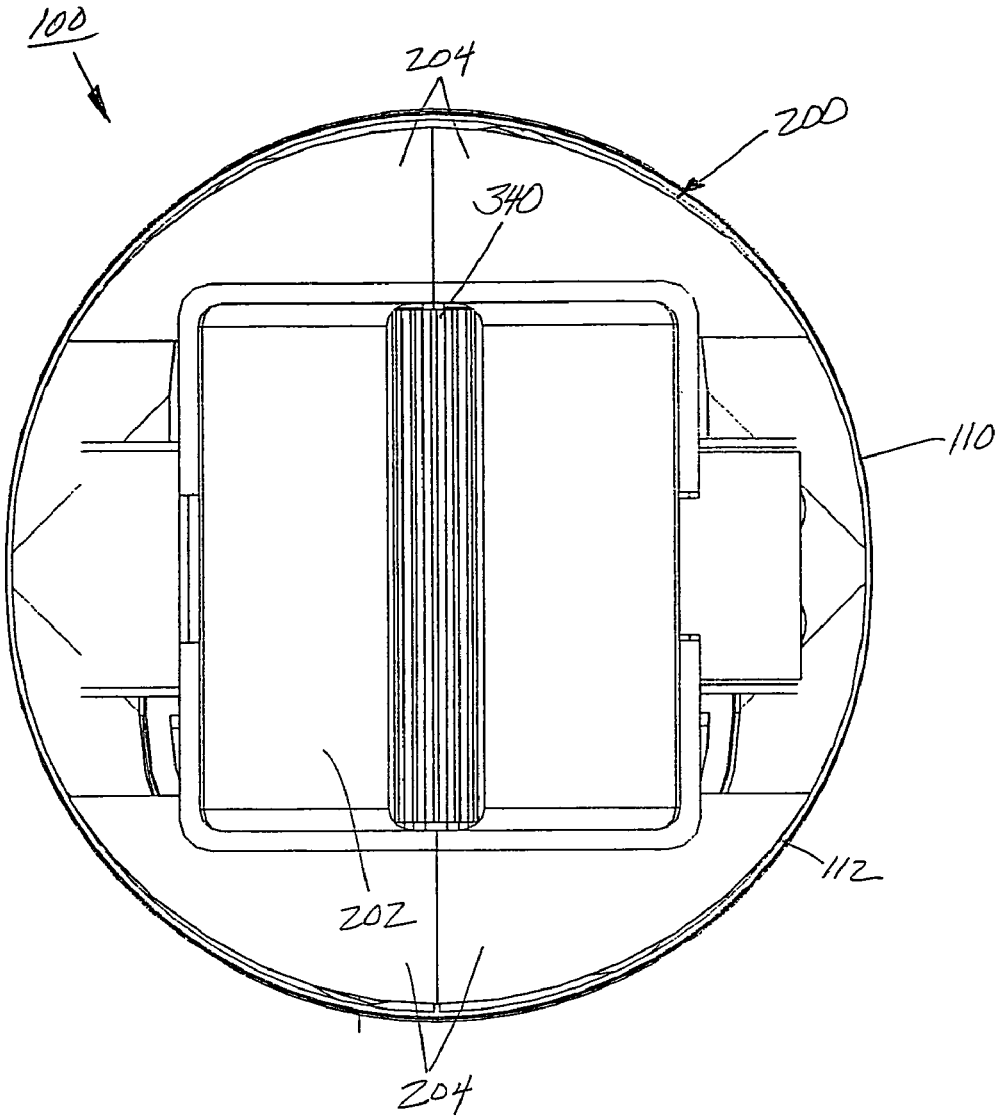
FIG. 6 is a top view of the dispenser of FIG. 1, taken along line 6-6 of FIG. 2, such vantage point depicting the dispenser with the top cover thereof having been removed.
Figure 7:
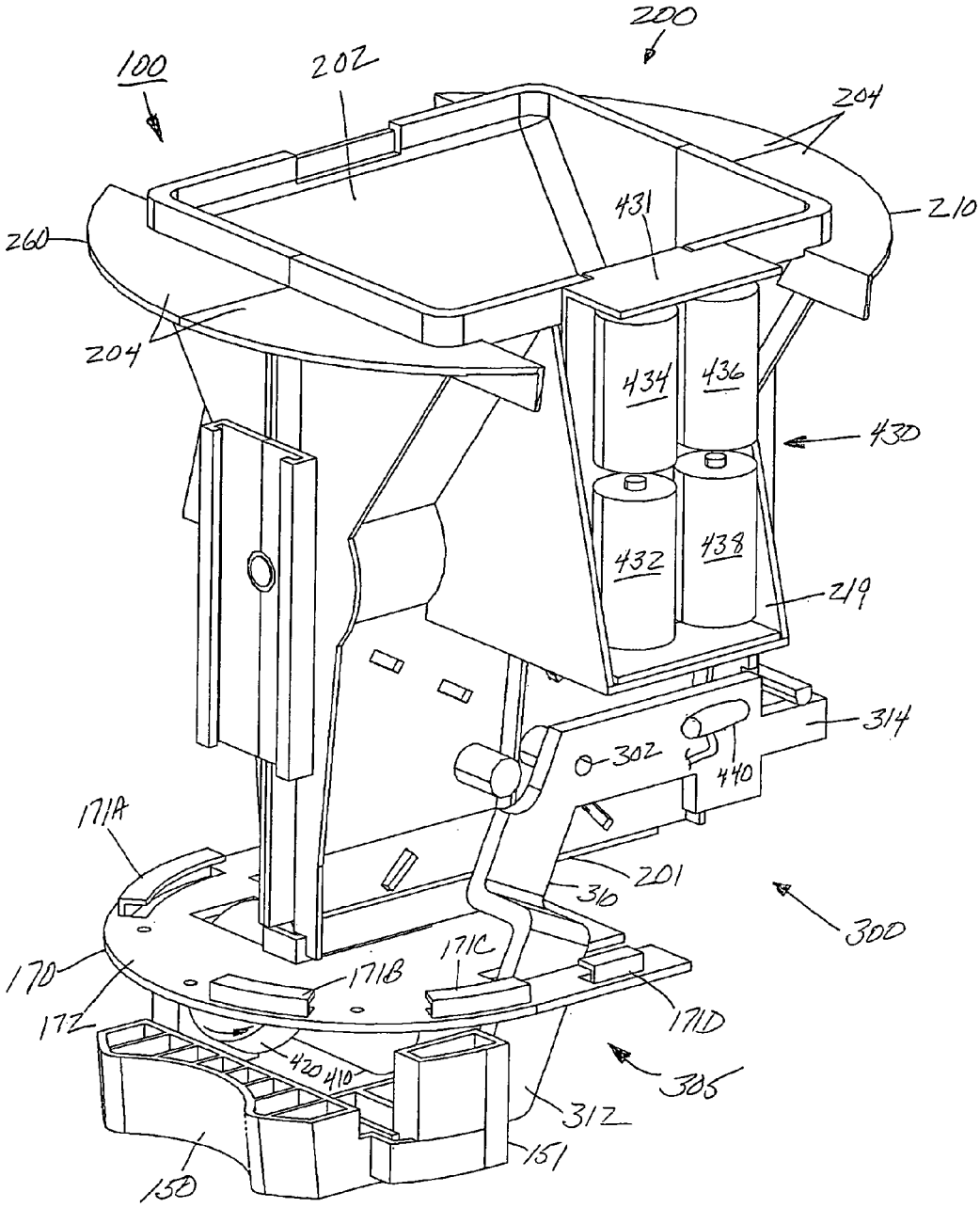
FIG. 7 is a front right perspective view of the inner mechanisms of one embodiment of the applicant's dispenser.
Figure 8:
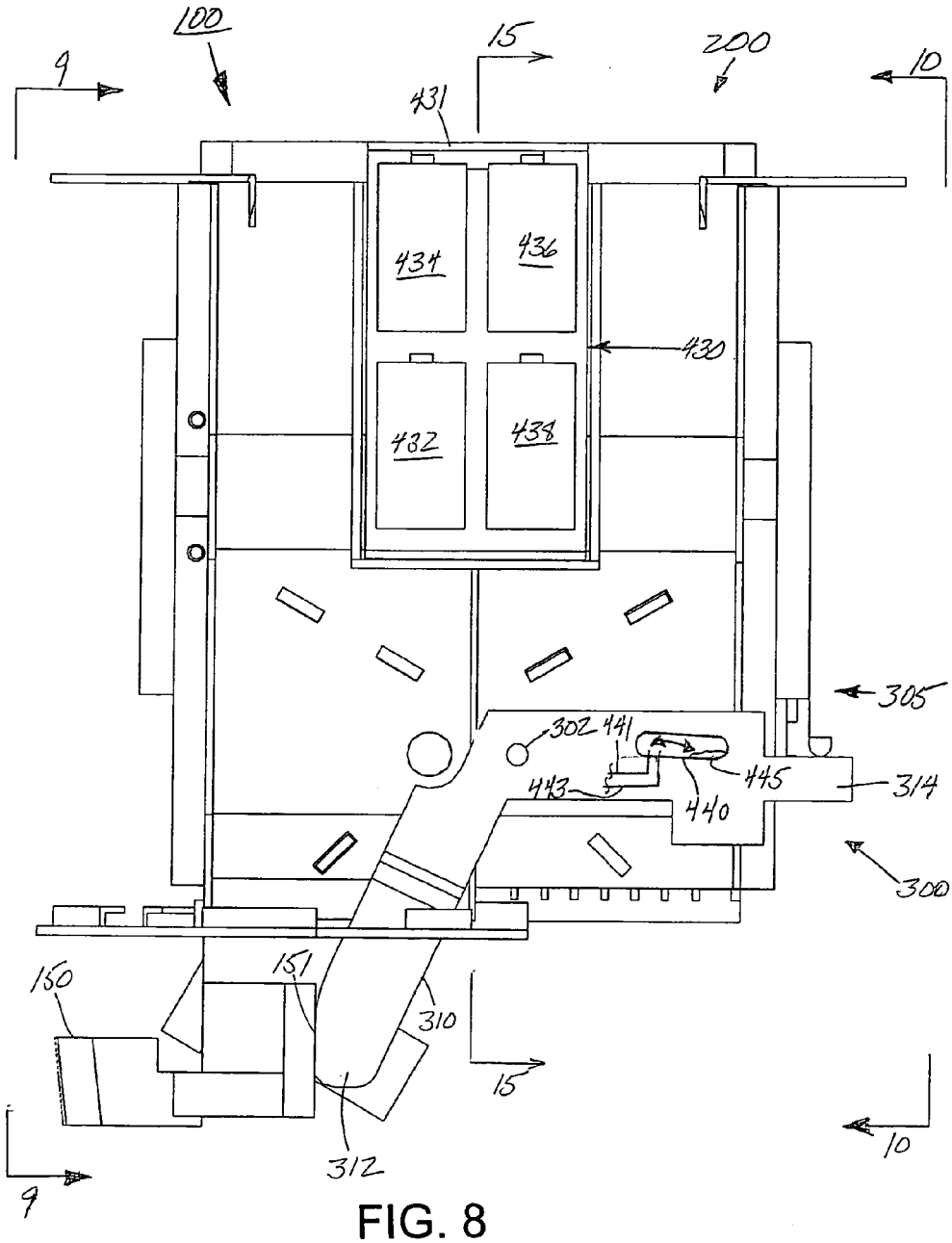
FIG. 8 is a side view of the inner mechanisms of the applicant's dispenser.
Figure 9:
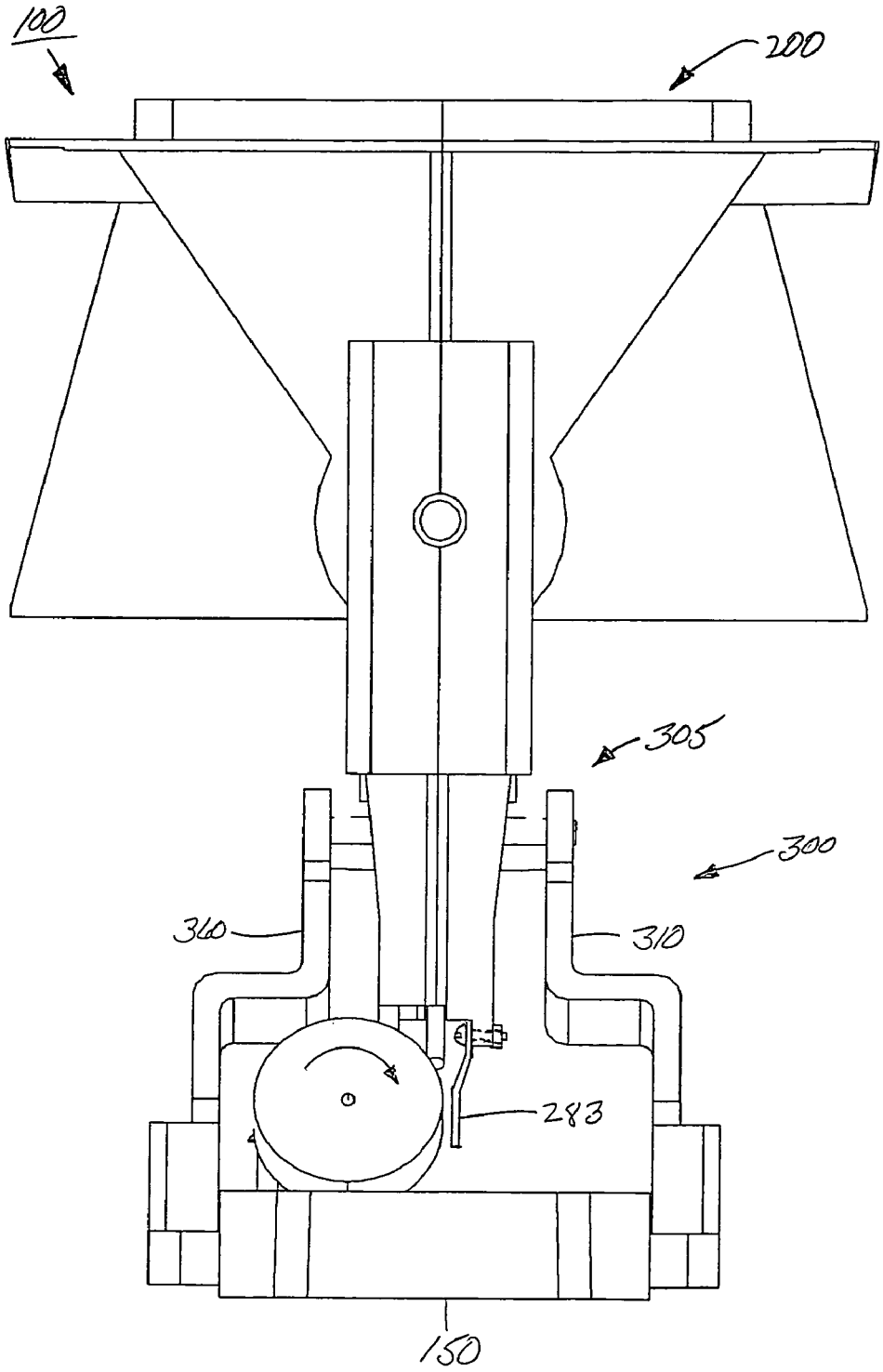
FIG. 9 is a front view of the inner mechanisms of the applicant's dispenser taken along line 9-9 of FIG. 8.
Figure 10:
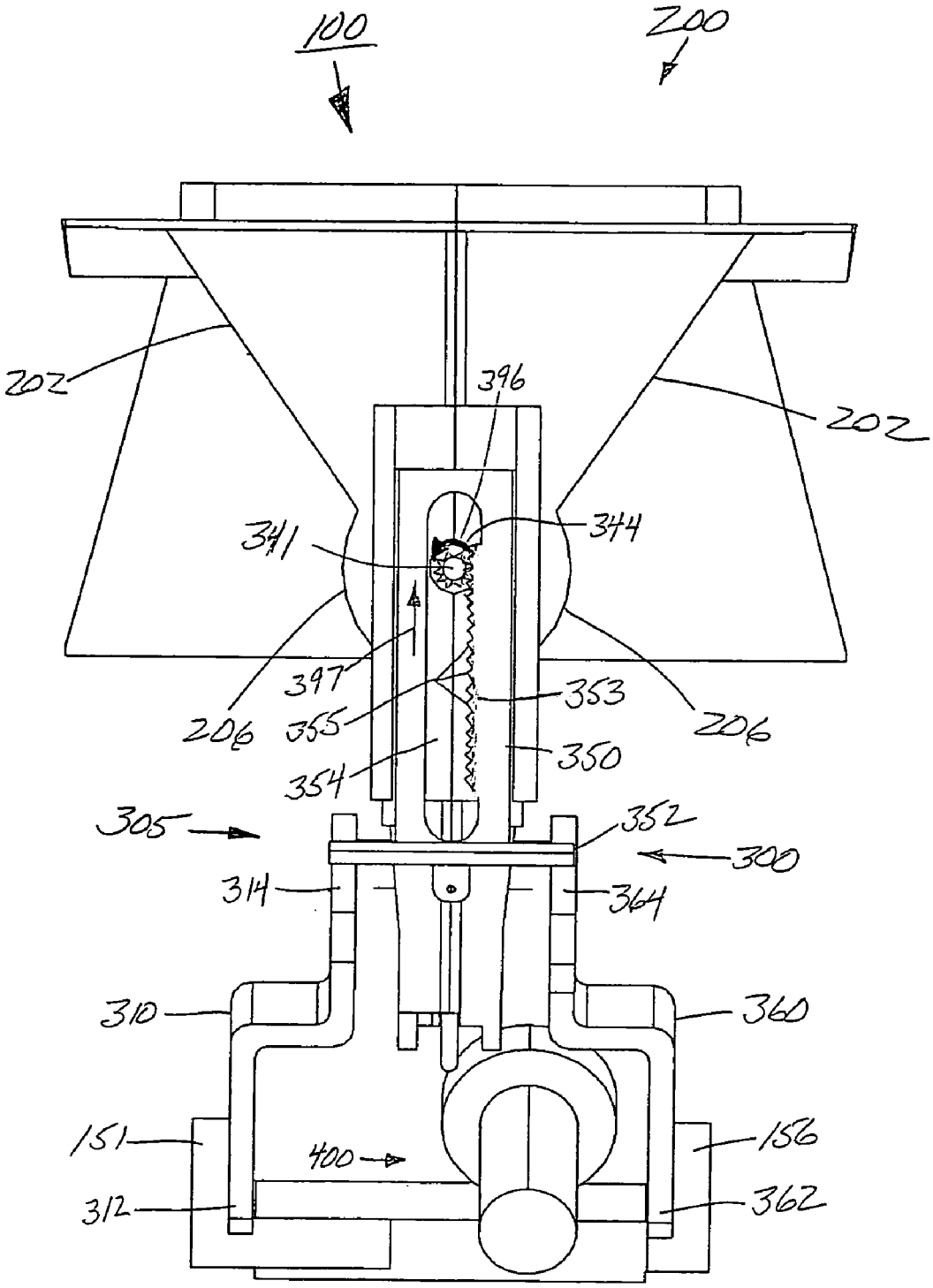
FIG. 10 is a back view of the inner mechanisms of the applicant's dispenser taken along line 10-10 of FIG. 8.
Figure 11:
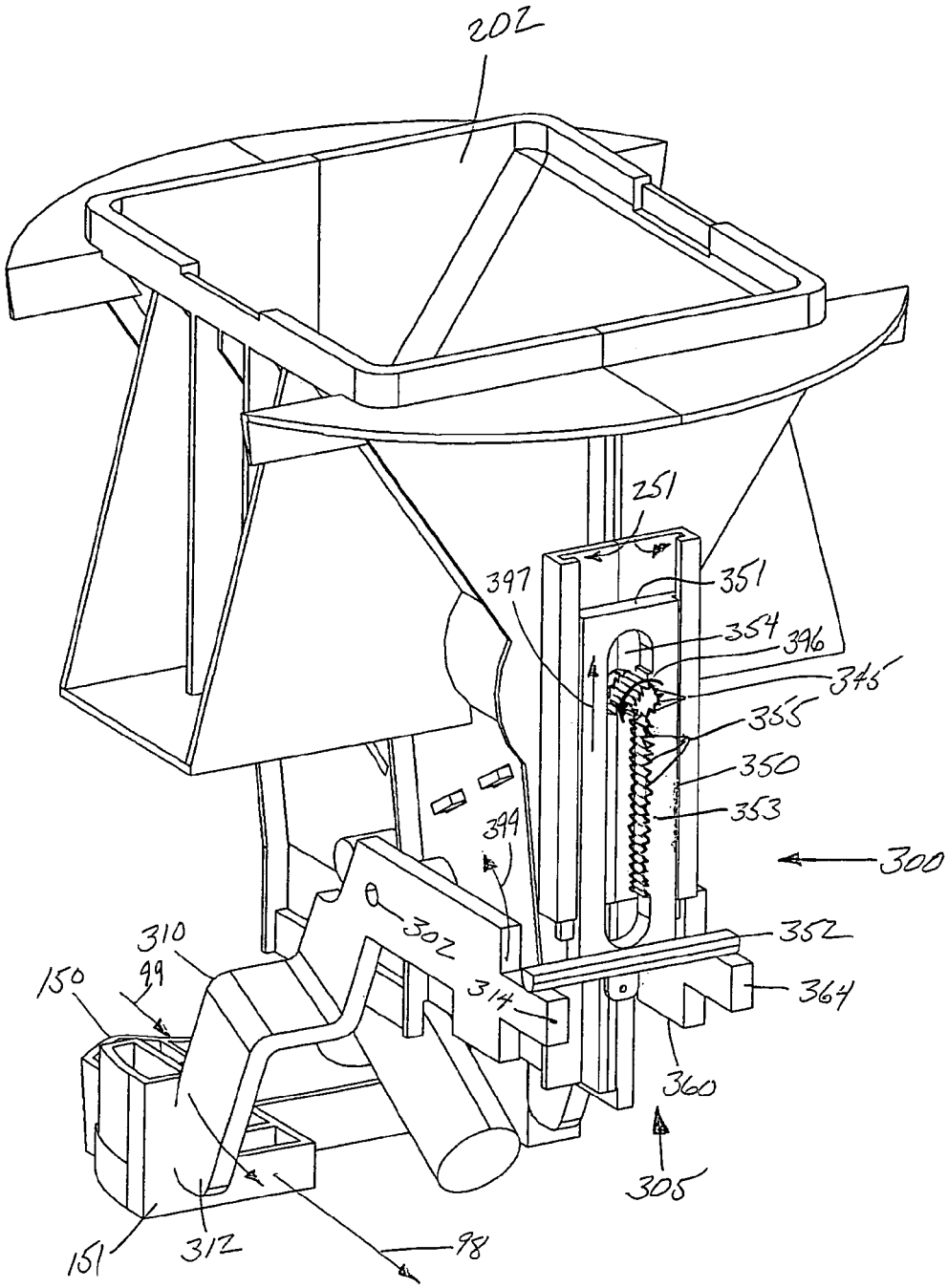
FIG. 11 is first rear right perspective view of the inner mechanisms of one embodiment of the applicant's dispenser.
Figure 12:
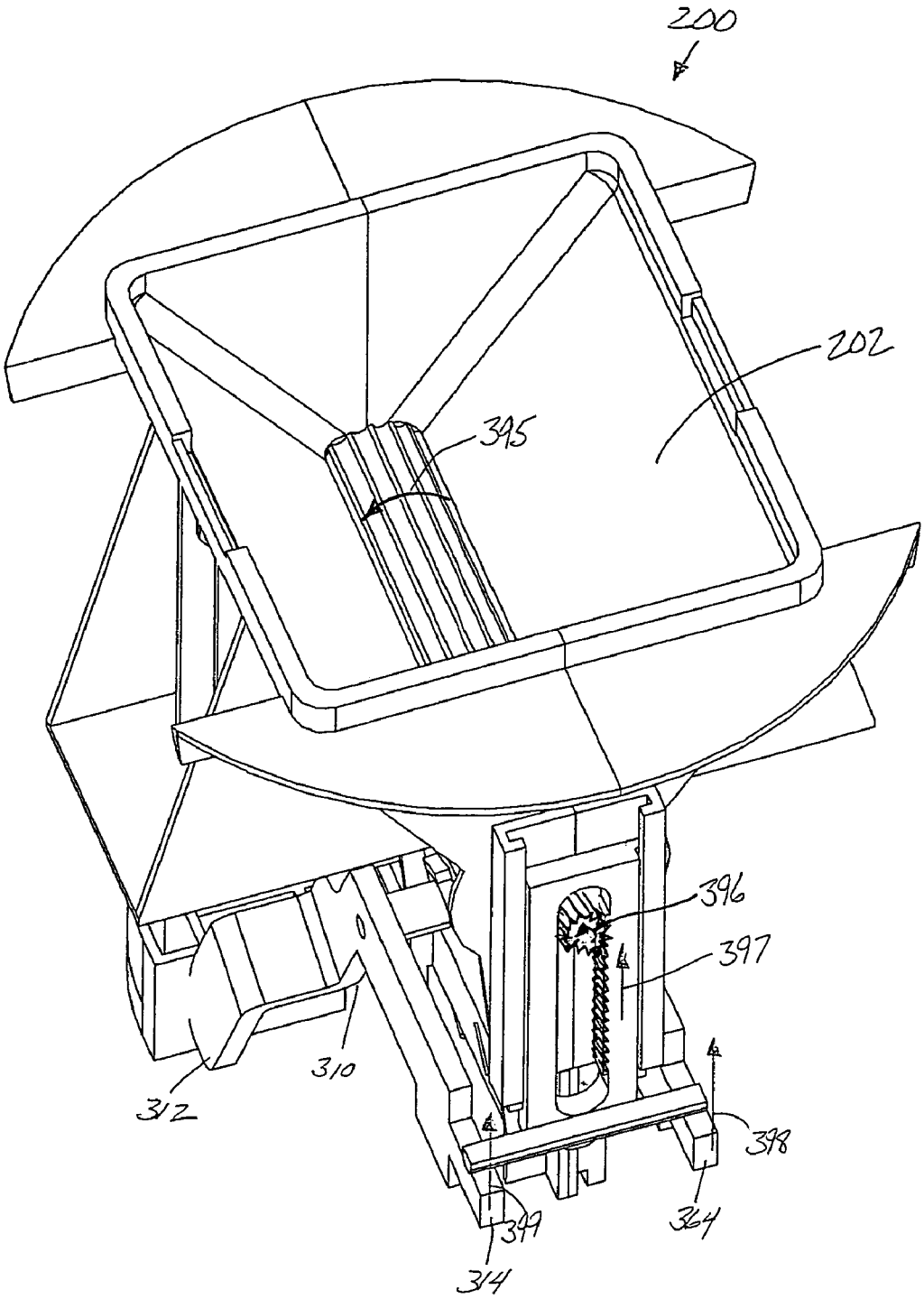
FIG. 12 is second rear right perspective view of the inner mechanisms of one embodiment of the applicant's dispenser taken from a higher perspective.

FIG. 6 is a top view of the dispenser of FIG. 1, taken along line 6-6 of FIG. 2, such vantage point depicting the dispenser with the top cover thereof having been removed. FIG. 7 is a front right perspective view of the inner mechanisms of one embodiment of the applicant's dispenser. FIG. 8 is a side view of the inner mechanisms of the applicant's dispenser. FIG. 9 is a front view of the inner mechanisms of the applicant's dispenser taken along line 9-9 of FIG. 8. FIG. 10 is a back view of the inner mechanisms of the applicant's dispenser taken along line 10-10 of FIG. 8. FIG. 11 is first rear right perspective view of the inner mechanisms of one embodiment of the applicant's dispenser.

Referring first to FIG. 6, dispenser 100 is shown with cover 120 (see FIG. 1) having been removed. Beneath cover 120 there is housed within housing 110 a hopper assembly 200, having a V-shaped hopper bin 202. Hopper assembly 200 preferably further comprises a flange 204 formed around the upper perimeter thereof, for the purpose of providing added structural strength, and for providing a surface for the locating and securing of the upper portion of housing 110 thereto.

Referring now to FIG. 10, hopper assembly further comprises a cylindrical cavity 206 formed at the base of V-shaped hopper bin 202. Cylindrical cavity 206 is provided to house a straw conveying drum, to be described subsequently in this specification.

Referring now to FIG. 7, dispenser 100 further comprises a base plate 170, which is joined to hopper assembly 200 at the lower portion 201 thereof by fasteners (not shown) or by snap-together features (not shown) provided thereupon. Base plate 170 is preferably further provided with engagement features 171A-171D on the upper surface 172 thereof for engagement with housing 110 for securing thereto. Base plate 170 is preferably further provided with similar engagement features (not shown) on the lower surface thereof for engagement with base 130 for securing thereto. It will be apparent that other suitable fastening means could be provided for joining base plate 170 with housing 110 and/or base 130. It is noted that for the sake of simplicity of illustration, base plate 170 is only depicted in FIG. 7, and not in subsequent Figures, in order to depict other key features of the dispenser 100 in such Figures.

Referring now to FIGS. 7-11, dispenser 100 further comprises mechanical means 300 for actuating the dispensing apparatus 100 to effect the dispensation of stir straws or other rod shaped objects therefrom. The operation of mechanical means 300 results in the conveying of a stir straw from V-shaped hopper bin 202 of hopper assembly 200, and for releasing such stir straw from the lower portion 201 of such hopper assembly 200. Mechanical means 300 comprises actuator bar 150, previously described in this specification. Actuator bar 150 may have alternative shapes for engagement and/or contact and actuation with a beverage glass, such as a push-button shape.

Mechanical means 300 further comprises an actuating linkage assembly 305 comprising levers 310 and 360, each of which are pivotable around pin 302, which passes through the lower portion 201 of hopper assembly 200. The proximal ends 312 and 362 of levers 310 and 360 are in contact with the left portion 156 and the right portion 151 of actuator bar 150, such that when actuator bar 150 is pushed horizontally as indicated by arrow 98 (see FIG. 5B), levers 310 and 360 pivot around pin 302.

Actuating linkage assembly 305 further comprises slide bar 350, which is formed with a T-shaped cross section 351, and which is thus disposed within T-slot 251 formed in hopper assembly 200. Slide bar 350 is provided with a cross-bar 352, which rests upon the distal ends 314 and 364 of levers 310 and 360. Thus any vertical movement of such distal ends 314 and 364 of levers 310 and 360 result in vertical movement of slide bar 350, the T-shape 351 of which is slidingly engaged in T-slot 251. Slide bar 350 is further provided with an elongated slot 354 that has a plurality of teeth 355 formed on one side 353 thereof. Teeth 355 of slide bar 350 are engaged with the teeth 345 of gear 344, which is engaged with conveyor drum 340 (see FIG. 6). Slide bar 350 and gear 344 function together as a rack and pinion, respectively, thereby rotating conveyor drum 340 in order to convey a stir straw from hopper bin 202 and discharge such stir straw downwardly. It will be apparent that drum 340 could be provided with a wheel (not shown) instead of gear 344, and such wheel could be frictionally engaged with an edge of elongated slot 354, such an edge being relatively smooth instead of toothed. In this manner, the operation of actuating linkage assembly 305 would result in the same rotation of drum 340 in a rack and pinion arrangement, i.e. rack 350 and pinion 344. It will be further apparent that many other suitable mechanical arrangements may be used in which linear motion of a first part is converted to rotary motion of a second part engaged with such first part, to achieve the same result.

The details of the operation of mechanical means 300 to convey a stir straw from hopper bin 202 to a chute beneath conveyor drum 340, and the details of electromechanical means to more vigorously discharge such stir straw downwardly from the dispenser 100 will now be described with reference in particular to FIGS. 11-17B. When actuator bar 150 of linkage assembly 305 is displaced horizontally by the pushing action of a glass 21 (see FIG. 5B) as indicated by arrows 99 and 98, levers 310 and 360 are pivoted around the central axis of pin 302, such that the distal ends 314 and 364 thereof are displaced upwardly, as indicated by arrows 399 and 398. The upward movement of distal ends 314 and 364 result in a corresponding upward movement of slide bar 350 as indicated by arrow 397, since the cross bar 352 of slide bar 350 rests upon ends 314 and 364 of levers 310 and 360.

Since the plurality of gear teeth 355 of slide bar 350 are engaged with the teeth 345 of pinion gear 344, the upward movement of slide bar 350 results in the rotation of pinion gear 344 as indicated by arrow 396. Since pinion gear 344 is joined to a stub shaft 341 (see FIG. 10), which extends from conveyor drum 340, the rotation of pinion gear 344 as indicated by arrow 396 results in the corresponding rotation of conveyor drum 340 as indicated by arrow 395.

Figure 13:
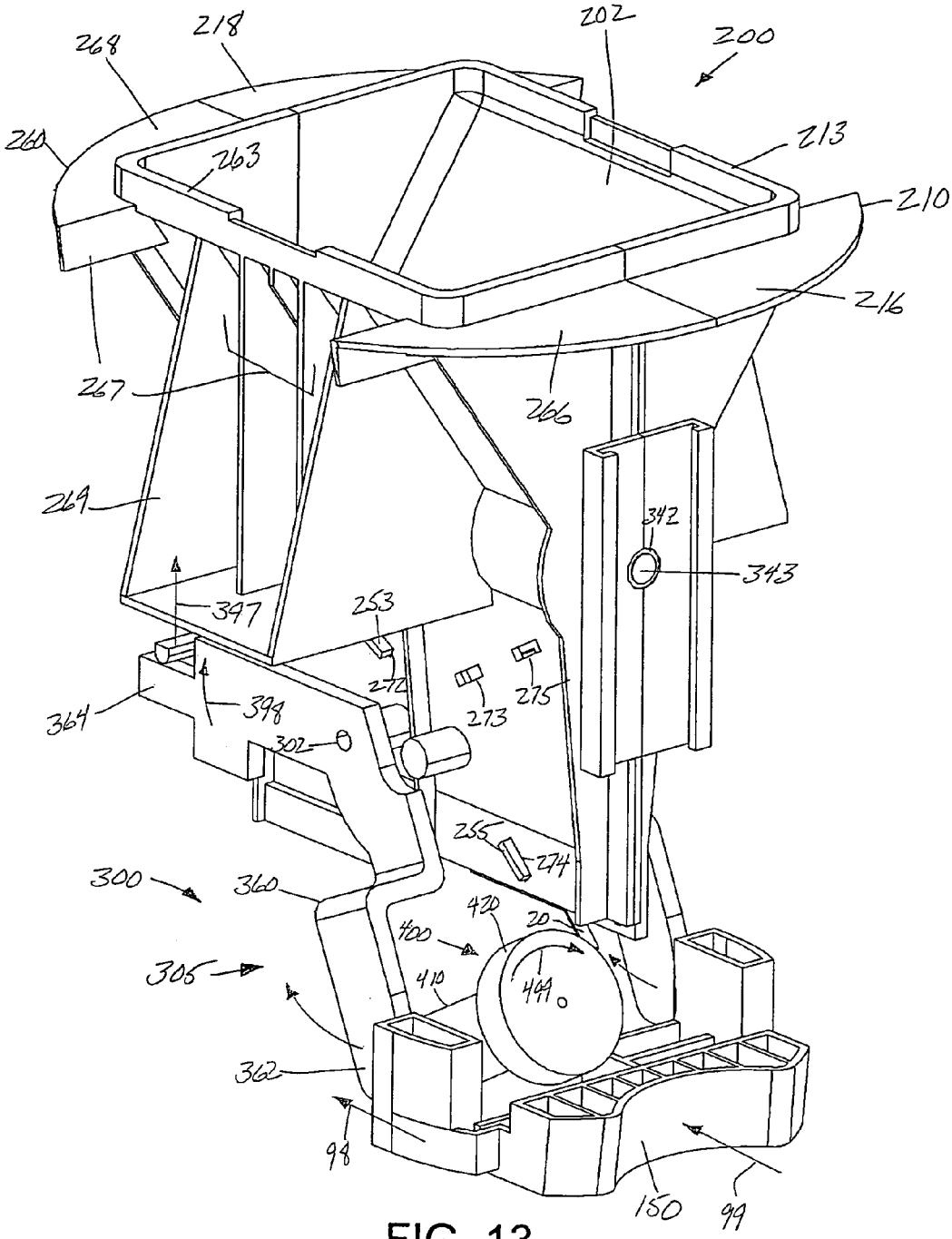
FIG. 13 is a first front left perspective view of the inner mechanisms of one embodiment of the applicant's dispenser.
Figure 14:
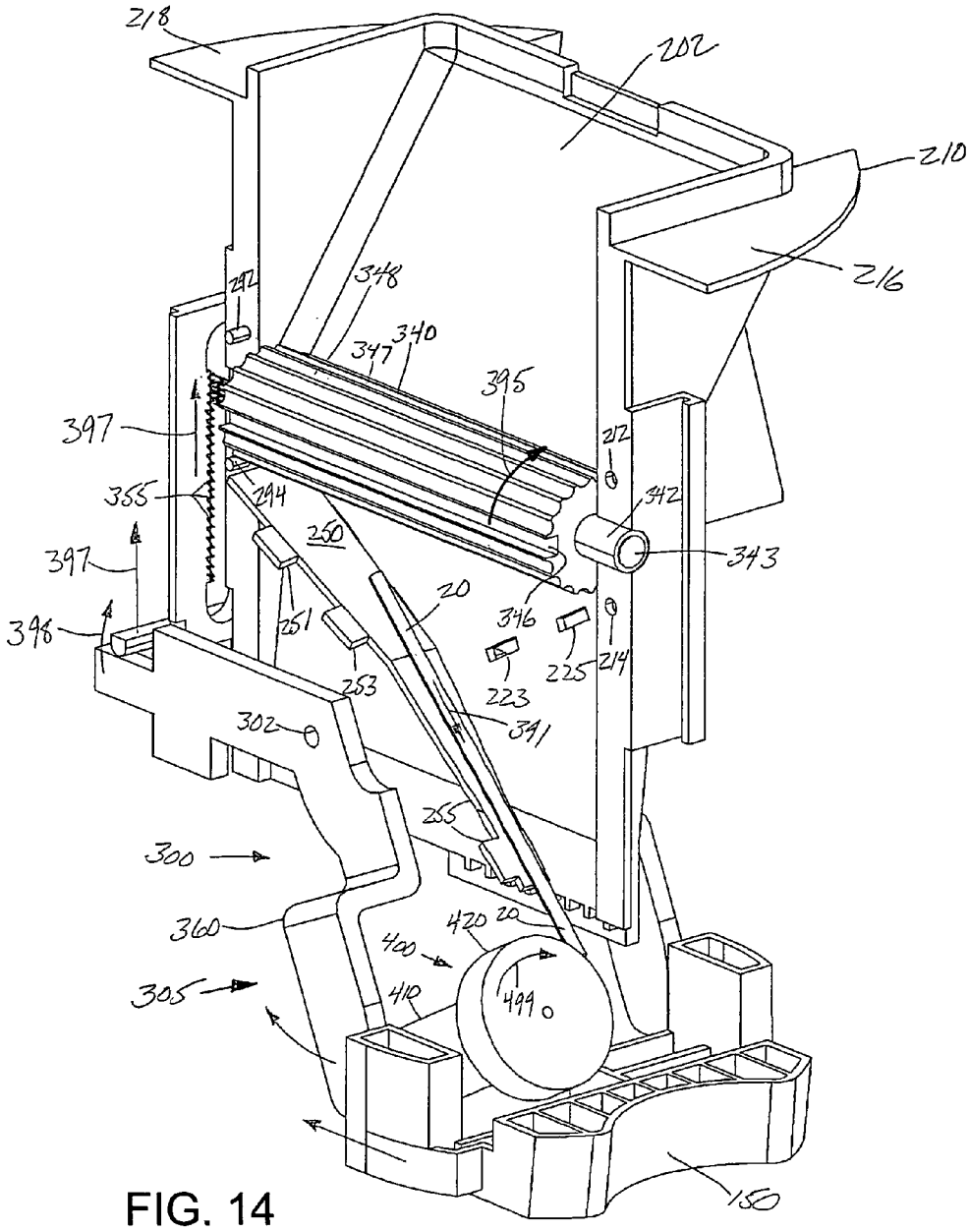
FIG. 14 is a second front left perspective view of the inner mechanisms of the embodiment of the applicant's dispenser depicted in FIG. 13, with the left half of the hopper assembly removed therefrom.
Figure 15:
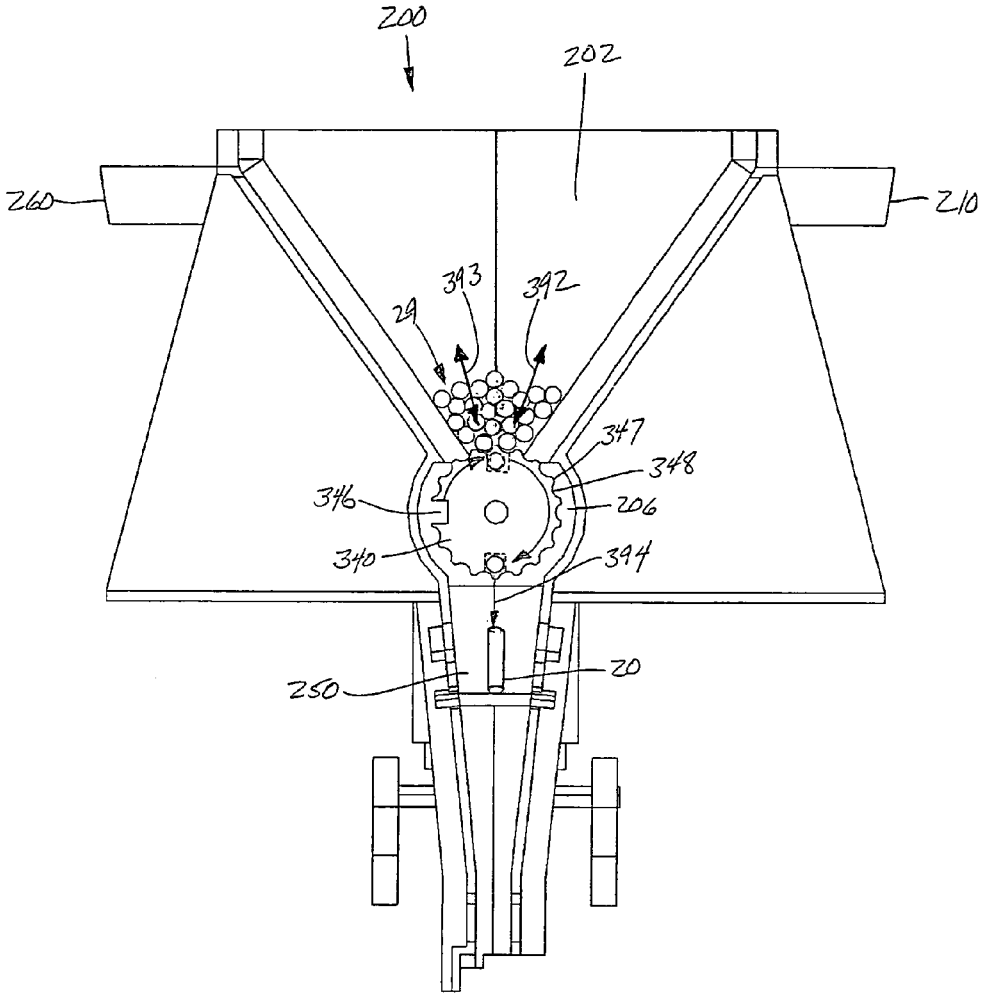
FIG. 15 is a cross-sectional view of the inner mechanisms of one embodiment of the applicant's dispenser taken along line 15-15 of FIG. 8.

Referring now to FIGS. 13, 14, and 15 in particular, FIG. 13 is a first front left perspective view of the inner mechanisms of one embodiment of the applicant's dispenser; FIG. 14 is a second front left perspective view of the inner mechanisms of one embodiment of the applicant's dispenser identical to the view of FIG. 13, but with the left half 260 of the hopper assembly 200 removed therefrom; and FIG. 15 is a cross-sectional view of the inner mechanisms of one embodiment of the applicant's dispenser taken along line 15-15 of FIG. 8. It can be seen that conveyor drum 340 is housed in a cylindrical cavity 206 formed between hopper halves 210 and 260 beneath hopper bin 202. Conveyor drum 340 is provided with stub shafts 341 (see FIG. 10) and 343, which are held within bushings 342 that are disposed in cylindrical cavities in the end walls that are formed between housing halves 210 and 260. Bushings 342 enable smooth low-friction rotation of conveyor drum 340. Alternatively, conveyor drum 340 could be mounted on bearings; however, bushings, being of lower cost, are preferred.

When actuating means 300 of dispenser 100 is actuated as described previously, resulting in the rotation of conveyor drum 340 as indicated by arrow 395, a stir straw 20 is conveyed from hopper bin 202, and discharged downwardly onto chute 250. In one preferred embodiment, conveyor drum 340 is provided with a slot 346 formed parallel to the central axis thereof on the outer perimeter surface thereof. Slot 346 is preferably between about 5 percent and about 50 percent larger than the diameter of the straw 20 to be dispensed.

Referring in particular to FIG. 15, at the beginning of the actuation cycle, slot 346 is preferably located approximately at the 10 o'clock to 12 o'clock position. Upon actuation cylinder 340 rotates to approximately the 6 o'clock position at which time (or possibly slightly earlier, depending upon the clearance between conveyor drum 340 and hopper halves 210 and 260 forming cavity 206) straw 20 falls downwardly onto chute 250 as indicated by arrow 394. Thus the rod-shaped straw or stick 20 is acquired at the approximately 12 o'clock position, and is then "indexed" or conveyed from the approximately 12 o'clock position to the approximately 6 o'clock position. Actuation means 300 is then released by withdrawing the glass 21 from contact with actuator bar 150 (see FIG. 5B). It will be apparent that all the components of actuating means revert to their at-rest positions along pathways in opposite directions to arrows 395 to 399, at which time straw drops into slot 346 from hopper bin 202 containing straws 29. (For the sake of simplicity of illustration, hopper bin 202 is shown with only about 10 percent of its capacity used.) In one embodiment, a stop 281 (see FIGS. 16 and 17A) is provided to limit the return travel of lever 360 and to locate its at-rest position. Such a stop 281 may be formed integrally or fastened to hopper assembly 200. In like manner, a similar stop (not shown) may be provided for locating the at-rest position of lever 310.

In the preferred embodiment depicted in FIGS. 14 and 15, conveyor drum 340 is further provided with ridges 347 and valleys 348 disposed axially on the outer surface thereof. As drum 340 rotates, the effect of these ridges 347 and valleys 348 is to provide agitation of the straws 29 in hopper bin 202, as indicated by arrows 393 and 392. This jostling of straws 29 in hopper bin 202 prevents straws 29 from becoming stuck together and/or jammed, and facilitates the dropping of a single straw 20 into slot 346 of drum 340. These features enable drum 340 to act as means for individually acquiring and indexing the rod shaped straws, stirring sticks, or other rod-shaped objects.

Referring now to FIGS. 13 and 14, certain advantageous features of the preferred embodiment of the applicants' dispenser are now described. In the preferred embodiment, hopper assembly 200 comprises two identical halves 210 and 260. In this manner, only one single part is required to be manufactured in order to provide both of hopper halves 210 and 260, thereby lowering the manufacturing cost of dispenser 100. It can be seen that hopper halves 210 and 260 are provided with holes such as e.g. holes 212 and 214 of hopper half 210, into which are pressed pins 292 and 294. When hopper halves 210 and 260 are pressed together, such pins join hopper halves 210 and 260 to each other.

Referring also to FIG. 6, the flange 204 of hopper assembly 200 is formed by quarter flanges 216 and 218 of hopper half 210, and quarter flanges 266 and 268 of hopper half 260. Such quarter flanges 216/218 are identical to quarter flanges 266/268. Hopper halves 210 and 260 may be further provided with upper lips 213 and 263 (see FIG. 13) for engagement with and location of cover 120 (see FIG. 1). Hopper halves 210 and 260 are preferably further provided with various gussets such as e.g., gussets 267 for added structural strength.

Hopper halves 210 and 260 are further provided with slotted openings such as e.g. slots 272 and 274 of hopper half 260, into which the tabs 251, 253, and 255 of chute 250 are snapped when hopper halves 210 and 260 are joined together. It will be apparent that some of such slots such as 223, 225, 273, and 275 are left unused when hopper halves 210 and 260 are joined together.

In one embodiment, the single piece part made to provide hopper halves 210 and 260 preferably consists essentially of PC/ABS polymer blend with a wall thickness of between about 2 mm to about 6 mm formed by injection molding. In one embodiment, conveyor drum 340 is preferably consists essentially of the same materials, and has approximately the same wall thickness. Alternatively, conveyor drum may be cast or machined from another suitable solid material, such as e.g. aluminum. It will be apparent to those skilled in the art that the remaining components of mechanical means 300, such as levers 310 and 360, pin 302, and actuator bar 150 may be similarly formed of suitable polymers, composites, and/or metals as cost and functional considerations warrant.

Referring now to FIG. 7 and FIG. 13, hopper halves 210 and 260 are preferably further provided with compartments 219 and 269, the purpose of which will now be described with regard to further electromechanical means provided for more vigorous dispensing of a stir straw from apparatus 100. It is to be understood that while preferred, such means is optional. In one embodiment, apparatus 100 may be provided such that when a straw 20 is acquired and indexed from hopper 202 and drops onto chute 250, such straw 20 simply slides down chute 250, and out through an opening in apparatus 100 into a glass 21 as depicted in FIG. 5B.

Referring to FIGS. 7, 13, and 14, dispenser 100 is preferably provided with electromechanical means 400 for vigorously discharging an indexed rod shaped object. In particular, such means provides a more positive ejection of a stir straw 20 from dispenser 100. Electromechanical means 400 comprises an electric motor 410 that is joined to base plate 170 and/or hopper assembly 200 by brackets (not shown) and common fasteners (not shown), or by other suitable fastening means. Electromechanical means 400 further comprises a wheel 420 that is operatively joined to motor 410, and is thus rotatable as indicated by arrow 499.

In one embodiment, motor 410 is supplied electrical power by a 120 volt outlet, and is connected to such outlet by a power cord (not shown). In the preferred embodiment, however, electromechanical means further comprises an on-board power supply, thereby rendering dispenser 100 more flexible in its positioning upon a countertop. Referring in particular to FIG. 7, and in the preferred embodiment, electromechanical means further comprises a battery pack 430 disposed in compartment 219 of hopper half 210. It will be apparent that the corresponding compartment 269 of hopper half 260 may be left empty, or may be further provided with an additional battery pack.

Battery pack 430 preferably comprises a connector bracket 431, and at least one battery. Battery pack preferably comprises a plurality of batteries 432, 434, 436, and 438, with connector bracket 431 providing an electrical connection between such batteries, and preferably a series connection. It will be apparent that many alternative battery and compartment configurations may be provided that would provide electric power to motor 410.

Electromechanical means 400 further comprises wiring (not shown) that electrically connects battery pack 430 to electric motor 410. Electromechanical means 400 preferably further comprises an electric switch, such as e.g., tilt switch 440 (see FIGS. 7 and 8). Tilt switch 440 may comprise mercury 445 within an enclosed tube, such that when switch 440 is tilted, switch 440 electrically connects wires 441 and 443 in the power supply wiring (not shown) to motor 410. Switch 440 is actuated when a glass 21 (see FIG. 5B) is pressed against actuator bar 150, actuating mechanical means 300 as described previously.

Thus in the operation of apparatus 100, when mechanical means 300 is actuated as described previously, switch 440 is closed, and power is supplied to motor 410, thereby rotating wheel 420 as indicated by arrow 499. When stir straw 20 drops onto chute 250 and slides downwardly as indicated by arrow 391, straw 20 frictionally engages with wheel 420, and the angular momentum of wheel 420 is transferred to straw 20, thereby ejecting straw 20 vigorously from dispenser 100 into glass 21 as indicated by arrow 97 (see FIG. 5B). In this manner, straw 20 is "punched" through any ice or slush in the beverage in glass 21, and no further hand touching of straw 20 is required of the holder of glass 21.

In one embodiment, wheel 420 is made of a "sticky" high friction polymer, to provide strong frictional engagement with straw 20 for a positive ejection. In another embodiment, there is provided a bracket 283 (see FIG. 9) adjacent to wheel 420 that provides a "pinch point" between such bracket and wheel 420, for strong frictional engagement thereof with straw 20. In another embodiment, there is provided an idler wheel adjacent to wheel 420 that provides a "pinch point" between such bracket and wheel 420, for strong frictional engagement thereof with straw 20.

Figure 16:
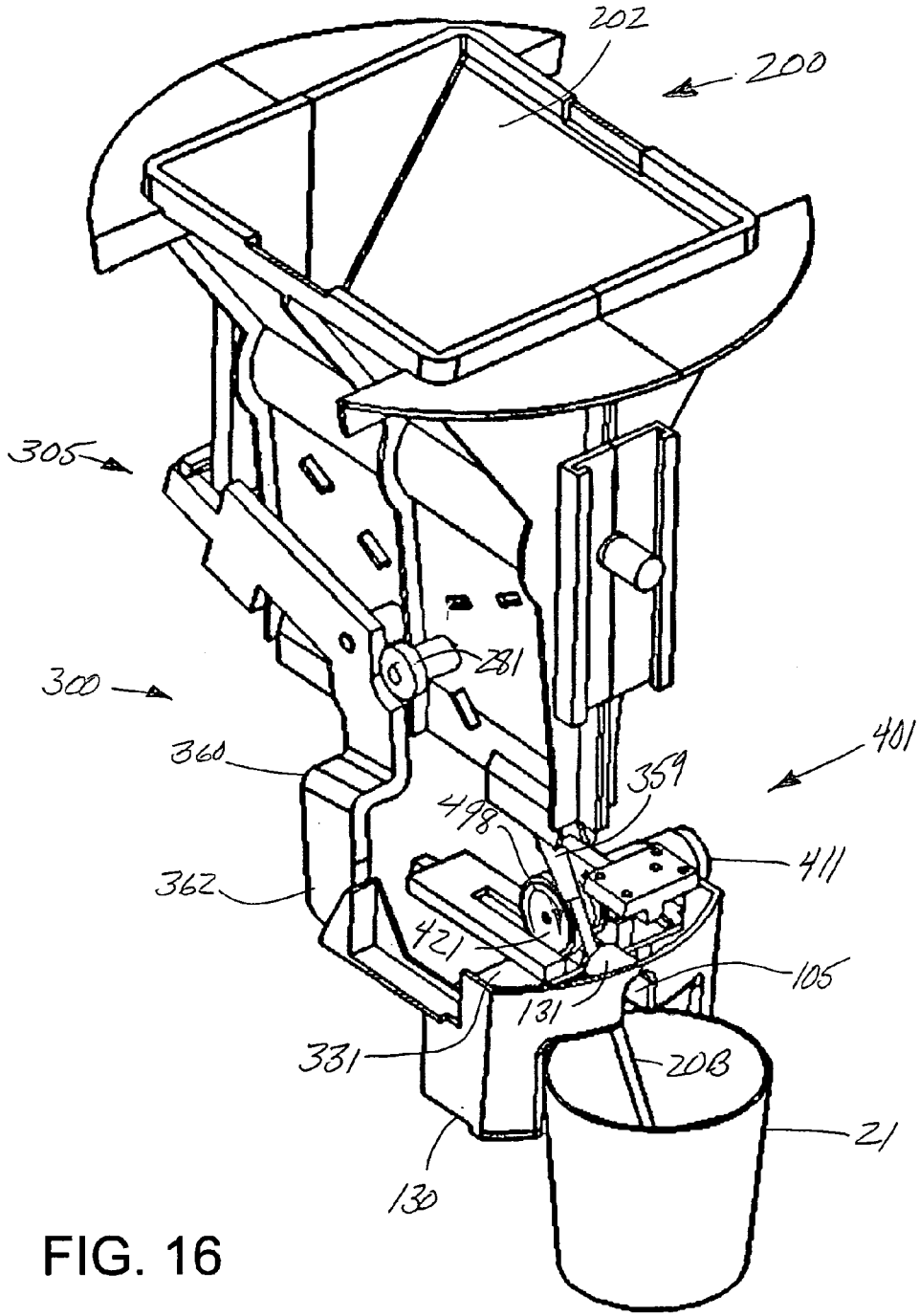
FIG. 16 is a front left perspective view of the inner mechanisms of an alternate embodiment of the applicant's dispenser, in which means for discharging a rod shaped object are placed in an alternate position.
Figures 17A, 17B:
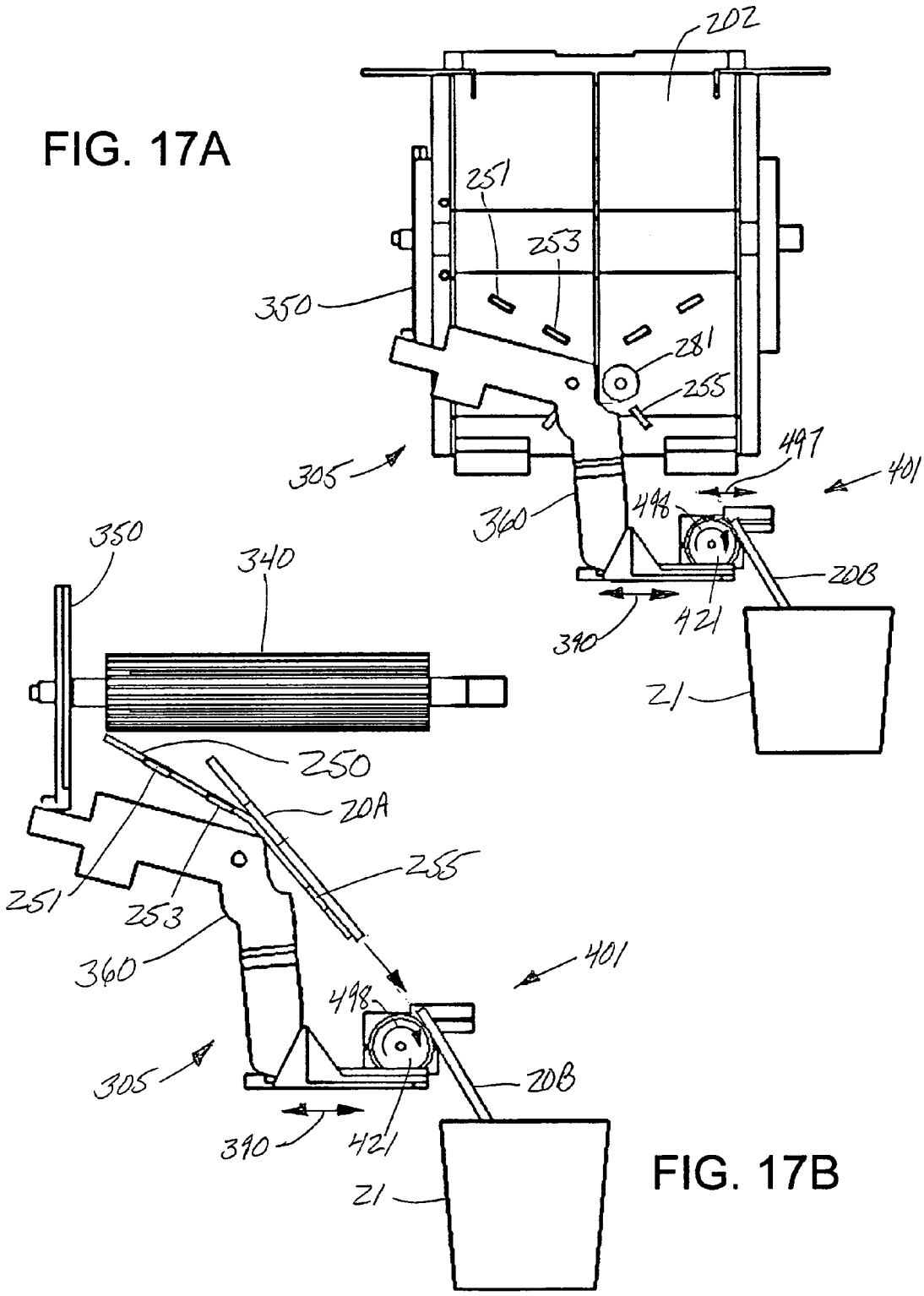
FIG. 17A is a left side elevation view of the embodiment of FIG. 16, including the hopper assembly thereof.
FIG. 17B is a left side elevation view of the embodiment of FIG. 16, with the hopper assembly removed therefrom.

Alternate electromechanical means for vigorously discharging an indexed rod shaped object will now be described, with reference in particular to FIGS. 16, 17A, and 17B. FIG. 16 is a front left perspective view of the inner mechanisms of an alternate embodiment of the applicant's dispenser, in which means for discharging a rod shaped object are placed in an alternate position; FIG. 17A is a left side elevation view of the embodiment of FIG. 16, including the hopper assembly thereof; and FIG. 17B is a left side elevation view of the embodiment of FIG. 16, with the hopper assembly removed therefrom. Referring to FIGS. 16, 17A, and 17B, electromechanical means 401 comprises motor 411 and wheel 421 operatively joined to motor 411. Wheel 421 is rotatably driven by motor 411, and may be made of the same materials as is described herein for wheel 420 of FIG. 13. Additionally motor 421 is provided with electrical power in substantially the same manner as motor 410 of FIG. 7, and motor 411 and wheel 421 are electrically operated by the actuation of mechanical means 300 as described previously herein.

When mechanical means 300 is actuated, a straw 20 is indexed by conveyor drum 340, and drops onto chute 350 as described previously herein. Indexed straw 20A slides downwardly along chute 350 under the force of gravity, and contacts the perimeter of wheel 421, spinning as indicated by arrow 498. The perimeter surface of wheel 421, being of a high friction material as previously described, gets traction against straw 20A, and thus applies substantial additional force upon straw 20A in a direction that is tangential to the point of contact between straw 20A and wheel 421, thus vigorously accelerating and driving straw 20A out of the opening 105 of apparatus 100, and into glass 21 and any beverage therein, as indicated by the presence of straw 20B in FIGS. 16A-17.

In one embodiment, motor 411 and wheel 421 are joined to base plate 170 and/or hopper assembly 200 by brackets (not shown) and common fasteners (not shown), or by other suitable fastening means, as was described for motor 410 and wheel 420 of FIGS. 7 and 9. In this embodiment, friction between straw 20A and wheel 421 may be increased by providing a guide feature 131 in base 130 such that when indexed straw 20A slides down chute 350 and contacts wheel 421, the leading tip of straw 20A also impacts and is guided downwardly by guide feature 131. This guidance results in leverage of straw 20A against wheel 421, thus providing effective traction with wheel 421, and a vigorous ejection of straw 20A from apparatus 100.

Referring again to FIG. 16, and in another embodiment, the chute 350 of apparatus 100 is provided with a funnel-like guiding extension 359 that guides the leading edge of straw 20A onto wheel 421, and that provides a pinch point with wheel 421, much in the same manner as was described for bracket 283 and wheel 420 of FIG. 9.

In another embodiment depicted in FIGS. 16-17B, motor 411 and wheel 421 are mounted on a cross-plate 331 that is joined to levers 310 and 360, such that when apparatus 100 is actuated by the operation of actuator bar 150, motor 411 and wheel 421 move as indicated by arrow 497, with the motion of lever 360 and lever 310 as indicated by arrow 390. A straw 20A is discharged and slides down chute 350, and as actuator bar is released, motor 411 and wheel 421 return as indicated by arrow 497, such that wheel 421 instantly engages frictionally with straw 20A, and vigorously discharges straw 20A from apparatus 100.

In the filling of the hopper bin 202 of apparatus 100, stir straws are provided in sanitary packaging (not shown) with a tear away opening, such that such straws can be dumped into hopper bin 202 without contact with human hands. Such straws are dumped into hopper with an axial orientation generally parallel to the axis of conveyor drum 340, and such straws self-organize further into proper orientation for selection by drum 340 as a result of the jostling action provided by drum 340 as previously described. Thus in filling hopper bin 202, cover 120 is removed, straws are dumped from a package directly into hopper bin 202, and cover 120 is replaced.

It is, therefore, apparent that there has been provided, in accordance with the present invention, a method and apparatus for the sanitary dispensing of small stirring straws that are used to stir coffee, soft drinks, and alcoholic beverages where such beverages are sold, served, dispensed, and/or consumed. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

The invention claimed is:

1. A dispensing apparatus for dispensing rod-shaped objects comprising:

a. a hopper assembly comprised of a hopper bin, and a cylindrical cavity formed beneath said hopper bin;

b. disposed within said cylindrical cavity of said hopper assembly, a conveyor drum having a central rotational axis, a perimeter surface, and comprising a slot in said perimeter surface for acquiring and indexing one of said rod shaped objects, and a pinion extending outwardly along said central rotational axis through an end wall of said cylindrical cavity;

c. an actuating linkage assembly connected to said hopper assembly; said actuating linkage assembly including an actuator bar, and a rack engaged with said pinion wherein displacing said actuator bar rotates said pinion and said conveyor drum around said central rotational axis;

d. a chute for receiving said one of said rod shaped objects from said slot in said conveyor drum and guiding said one of said rod shaped objects out of said dispensing apparatus;

e. a housing and a cover enclosing said hopper assembly, said conveyor drum, and at least a portion of said actuating linkage assembly; and f. a base comprised of a step for engagement with an edge of a countertop.

2. The dispensing apparatus as recited in claim 1, wherein said rack of said actuating linkage assembly further comprises a longitudinal surface with a plurality of rack teeth, said pinion of said conveyor drum further comprises a gear including a plurality of gear teeth, and said rack teeth of said rack are engaged with said gear teeth of said gear.

3. The dispensing apparatus as recited in claim 1, wherein said hopper assembly is comprised of a first hopper half and a second hopper half.

4. The dispensing apparatus as recited in claim 3, wherein said first hopper half and said second hopper half are identical.

5. The dispensing apparatus as recited in claim 1, wherein said conveyor drum further comprises a plurality of ridges and valleys disposed axially on said outer perimeter surface.

6. The dispensing apparatus as recited in claim 1, further comprising a rotatable wheel engaged with an electric motor, said rotatable wheel for engaging and driving said one of said rod shaped objects that is received from said chute out of said apparatus.

7. A dispensing apparatus for dispensing rod-shaped objects comprising:

a. a hopper assembly comprised of a hopper bin, and a cylindrical cavity formed beneath said hopper bin;

b. disposed within said cylindrical cavity of said hopper assembly, a conveyor drum having a central rotational axis and a perimeter surface, and comprising a slot in said perimeter surface for acquiring and indexing one of said rod shaped objects, and a pinion extending outwardly along said central rotational axis through an end wall of said cylindrical cavity;

c. an actuating linkage assembly connected to said hopper assembly; said actuating linkage assembly including an actuator bar, and a rack engaged with said pinion wherein displacing said actuator bar rotates said pinion and said conveyor drum around said central rotational axis;

d. a chute for receiving said one of said rod shaped objects from said slot in said conveyor drum and guiding said one of said rod shaped objects out of said dispensing apparatus; and e. a rotatable wheel engaged with an electric motor, said rotatable wheel for engaging and driving said one of said rod shaped objects that is received from said chute out of said apparatus.

8. The dispensing apparatus as recited in claim 7, further comprising an electric power supply for providing electric power to said electric motor.

9. The dispensing apparatus as recited in claim 7, wherein said rack of said actuating linkage assembly further comprises a longitudinal surface with a plurality of rack teeth, said pinion of said conveyor drum comprises a gear including a plurality of gear teeth, and said rack teeth of said rack are engaged with said gear teeth of said gear.

10. The dispensing apparatus as recited in claim 7, wherein said hopper assembly is comprised of a first hopper half and a second hopper half.

11. The dispensing apparatus as recited in claim 10, wherein said first hopper half and said second hopper half are identical.

12. The dispensing apparatus as recited in claim 7, further comprising a housing and a cover enclosing said hopper assembly, said conveyor drum, and at least a portion of said actuating linkage assembly.

13. The dispensing apparatus as recited in claim 7, wherein said conveyor drum further comprises a plurality of ridges and valleys disposed axially on said outer perimeter surface.

14. A dispensing apparatus for dispensing rod-shaped objects comprising:

a. a hopper assembly comprised of a hopper bin, and a cylindrical cavity formed beneath said hopper bin;

b. disposed within said cylindrical cavity of said hopper assembly, means for acquiring a rod shaped object at a first position, and indexing said rod shaped object to a second position, thereby conveying an indexed rod shaped object, wherein said means for acquiring a rod shaped object at a first position, and indexing said rod shaped object to a second position comprises a conveyor drum having a central rotational axis, a perimeter surface, and comprising a slot in said perimeter surface for acquiring and indexing one of said rod shaped objects, and a pinion extending outwardly along said central rotational axis through an end wall of said cylindrical cavity;

c. means for actuating said dispensing apparatus to effect the dispensation of said rod shaped objects; and d. means for discharging said indexed rod shaped object, wherein said means for discharging said indexed rod shaped object comprises a chute for receiving said one of said rod shaped objects from said slot in said conveyor drum and guiding said one of said rod shaped objects out of said dispensing apparatus and wherein said means for discharging said indexed rod shaped object further comprises a rotatable wheel engaged with an electric motor, said rotatable wheel for engaging and driving said one of said rod shaped objects received from said chute out of said apparatus.

15. The apparatus as recited in claim 14, wherein said means for actuating said dispensing apparatus comprises an actuating linkage assembly connected to said hopper assembly; said actuating linkage assembly including an actuator bar, and a rack engaged with said pinion wherein displacing said actuator bar rotates said pinion and said conveyor drum around said central rotational axis.

* * * * *